United States Patent [19]

Hawkins

[11] Patent Number: 4,830,302

[45] Date of Patent: May 16, 1989

[54] FILM WINDING APPARATUS

[75] Inventor: William E. Hawkins, Circleville, Ohio

[73] Assignee: E. I. Du Pont de Nemours and Company, Wilmington, Del.

[21] Appl. No.: 483,368

[22] Filed: Apr. 8, 1983

[51] Int. Cl.[4] ..... B65H 18/16

[52] U.S. Cl. ..... 242/65; 242/56.4

[58] Field of Search ..... 242/67.1 R, 65, 75.1, 242/75.2, 76, 66; 226/196, 199; 26/101, 102, 103, 104; 139/304, 305; 162/271; 66/149 R, 152, 155

[56] References Cited

U.S. PATENT DOCUMENTS

| | | | |
|---|---|---|---|
| 1,026,482 | 5/1912 | White | 242/66 |
| 2,486,121 | 10/1949 | Corn | 226/199 X |
| 2,513,209 | 6/1950 | Roselene | 242/65 |
| 3,106,365 | 10/1963 | Karr | 242/76 |
| 3,222,004 | 12/1965 | Crowe | 242/65 |
| 3,298,624 | 1/1967 | Schott | 242/67.1 R |
| 3,305,153 | 2/1967 | Keding et al. | 226/199 X |
| 3,410,499 | 11/1968 | Schmidt | 242/67.1 R |
| 3,433,429 | 3/1969 | Schnitzspahn | 242/65 |
| 3,438,100 | 4/1969 | Moore | 26/101 |
| 4,343,440 | 8/1982 | Engl | 242/67.1 R |
| 4,374,575 | 2/1983 | Lerch et al. | 242/56.5 |
| 4,410,122 | 10/1983 | Frye et al. | 226/199 |

FOREIGN PATENT DOCUMENTS

| | | |
|---|---|---|
| 1179865 | 12/1958 | France . |
| 42-17781 | 9/1967 | Japan . |
| 54-48192 | 3/1979 | Japan . |
| 55-155747 | 10/1980 | Japan . |
| 57-28658 | 6/1982 | Japan . |

*Primary Examiner*—John M. Jillions

[57] ABSTRACT

An apparatus for winding thin films. Boundary air is discharged and the layers are compressed by a flexible, bowed idler roller located between a winding roll and a backup drive roll. High quality rolls free from wrinkles are produced.

7 Claims, 4 Drawing Sheets

FILM WINDING APPARATUS

BACKGROUND

This invention relates generally to the manufacture of thin film and, more particularly, to the winding of such film into rolls of high quality.

Equipment for winding rolls from a continuous length of film is available and in use. It is known that bowed rolls and/or spreader bars can be used in advance of the windup to flatten the film. Although such devices spread the film in transport, additional defects are introduced in the actual winding process. For example, as film is advanced to a roll, boundary air is entrapped and compressed slightly between the outside film layers and moves to regions between high spots or gage bands. This compressed air increases the diameter of the roll slightly where the film layers are thinnest. Resulting bubble-like areas reduce the laydown width. When the air bleeds to atmosphere, the affected film layers fold into wrinkles in the machine direction (MD). It is difficult, if not impossible, to avoid prominent, unacceptable wrinkles when winding ultra-thin film according to standard methods. Such wrinkles have an adverse effect on yield insofar as they present difficulties in achieving uniformity in subsequent coating, metallizing and laminating steps.

SUMMARY

Film has been wound into rolls of high quality on an apparatus which includes a winding roll, a drive roll and a flexible, bowed idler roller between and in contact with the winding and drive rolls. The idler roller is mounted between pivoted arms and means are provided for adjusting the arms to flex and thereby bow the roller.

DRAWINGS

Figure 1:
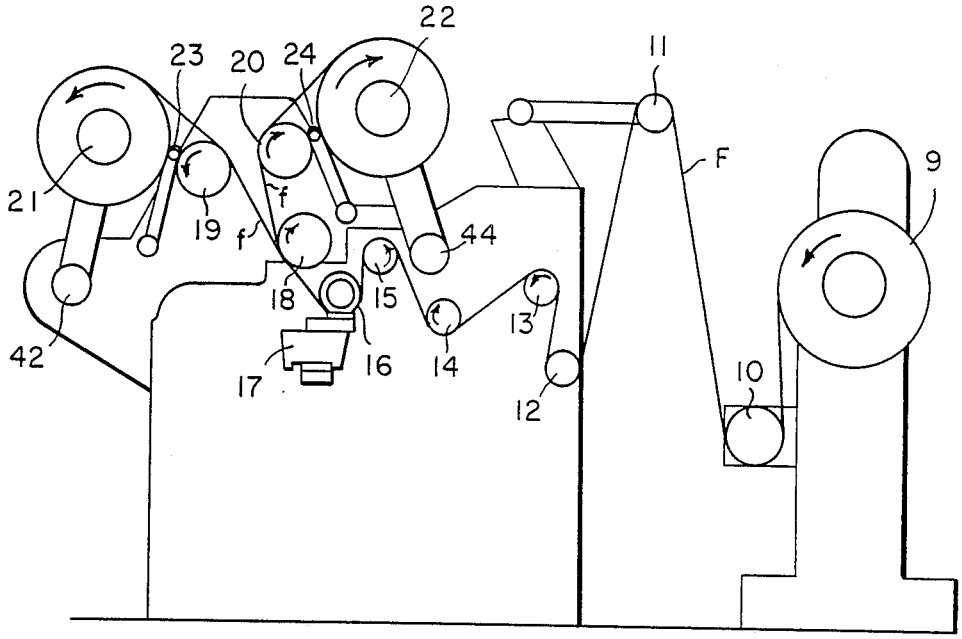
Figure 4A:
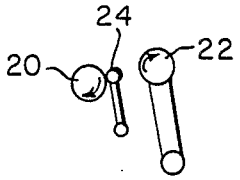
Figure 4B:
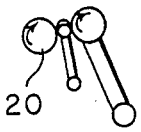
Figure 5:
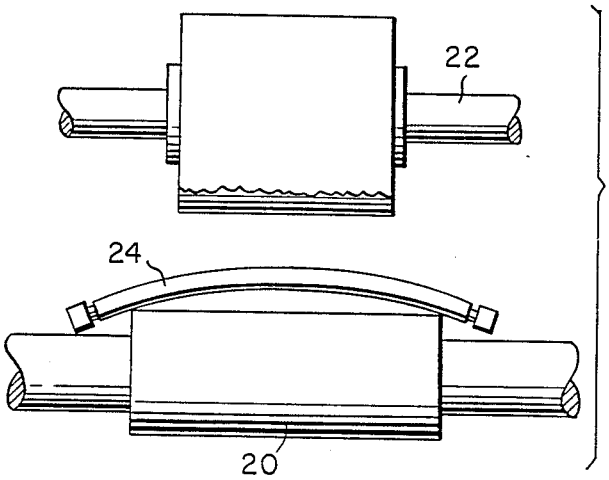
Figure 2:
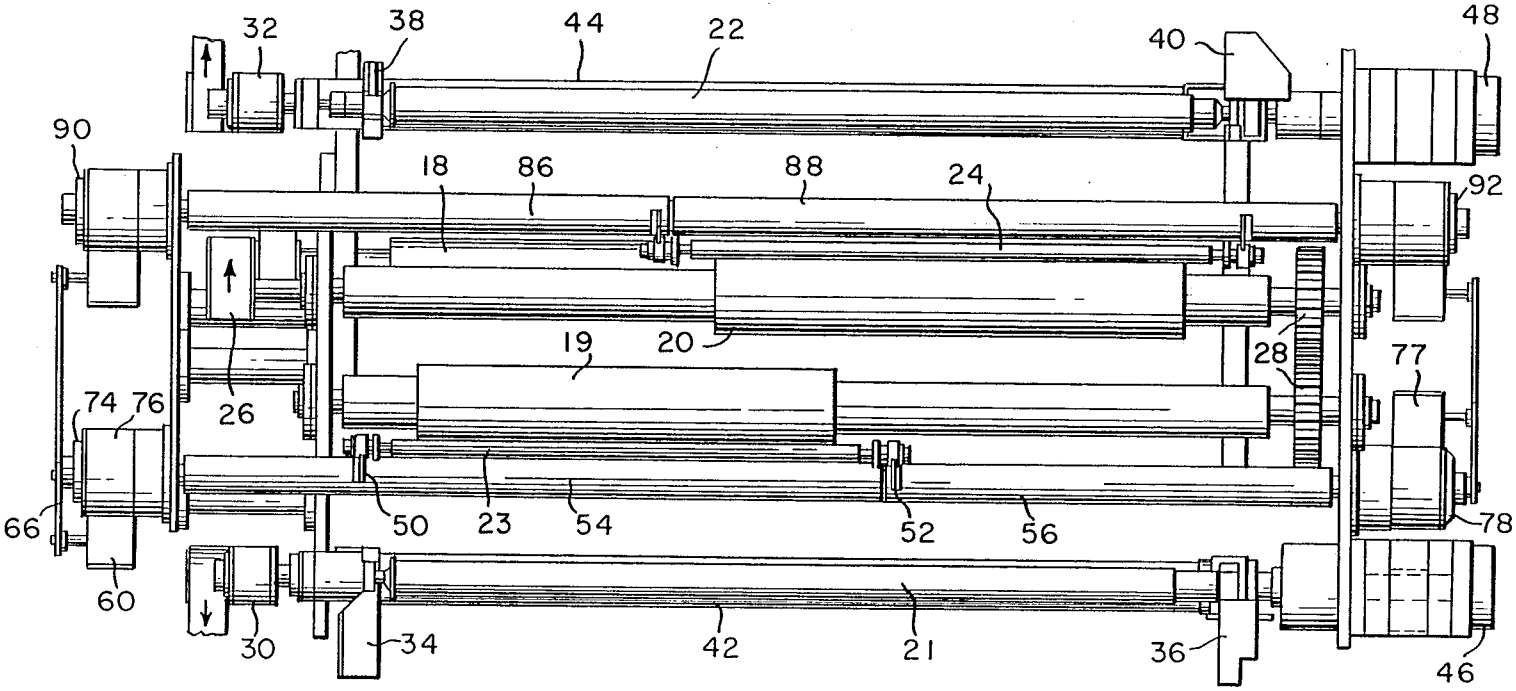
Figure 3:
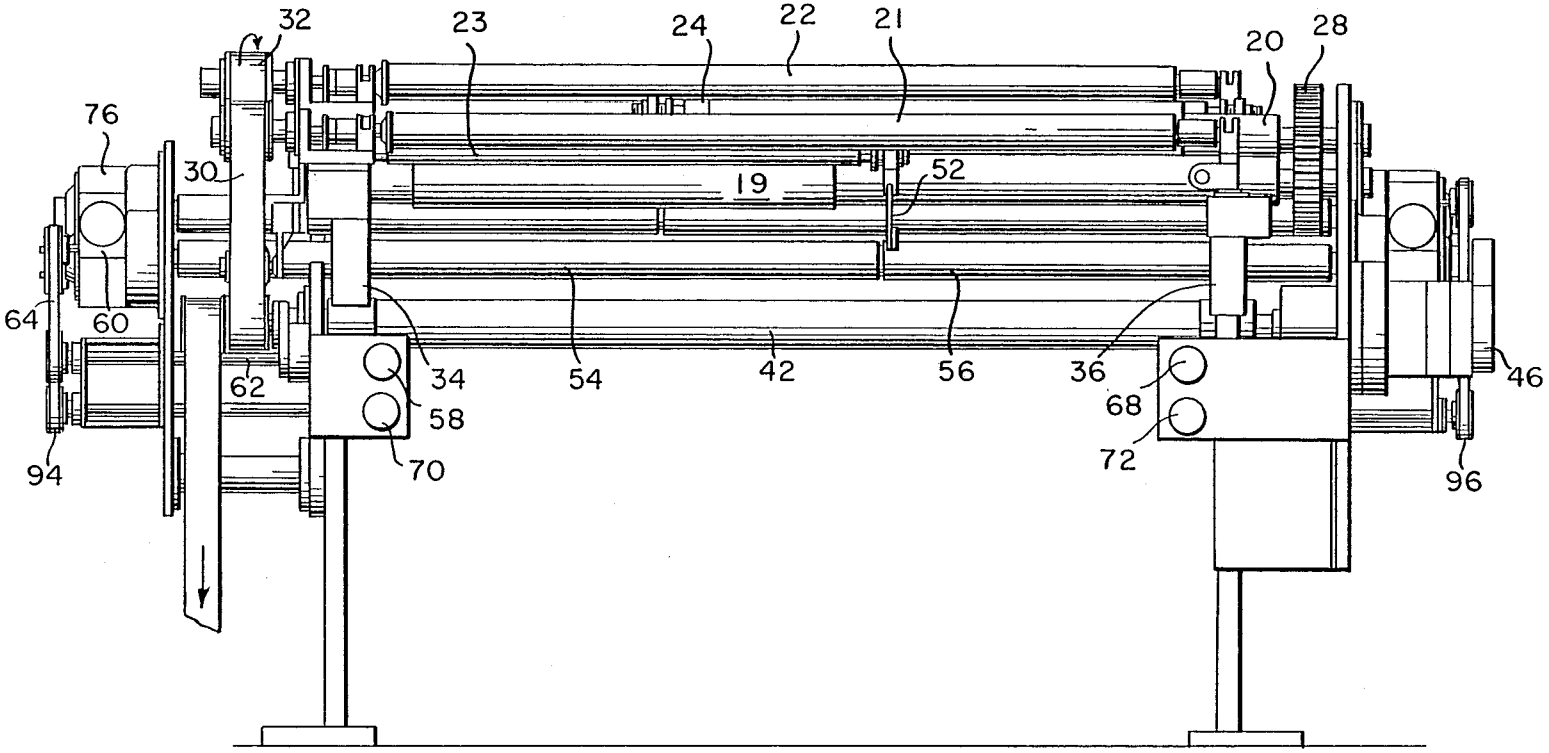
Figure 6:
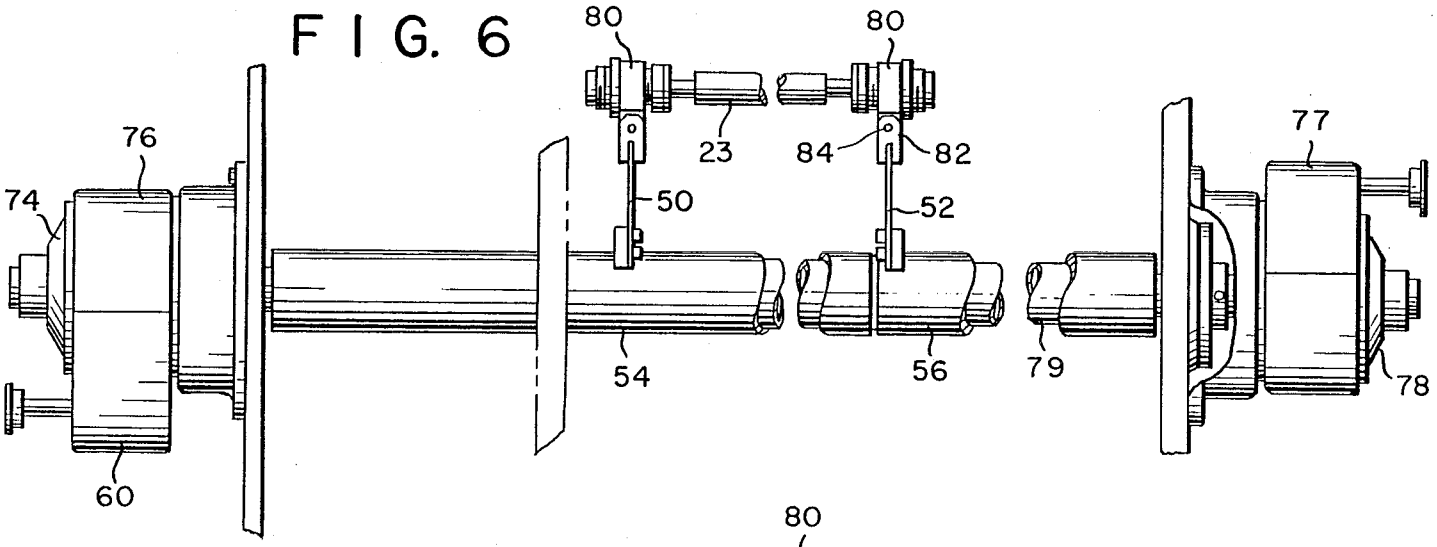
Figure 7:
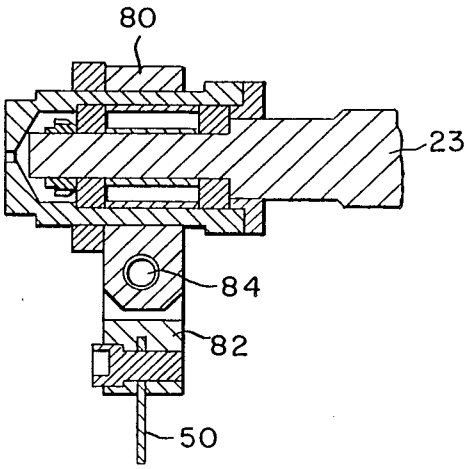

In the appended drawings,

FIG. 1 is a schematic, side view of a winding apparatus into which the flexible, bowed idler roller of the present invention has been incorporated, FIGS. 2 and 3 are top and end views of the apparatus, FIGS. 4A and 4B are schematic illustrations of the bow in the idler roller before and after it is engaged by a winding roll, FIG. 5 is a schematic illustration of the manner in which the idler roller is flexed and bowed, and FIGS. 6 and 7 are detailed illustrations of the pivoted arms and other parts which support the idler roller in the operative positions shown in FIGS. 1–5.

DESCRIPTION

Referring to FIG. 1, the apparatus into which the improvements of the present invention have been incorporated includes a stand for a mill roll 9. Film F from roll 9 advances over freely rotatable rolls 10, 11, 12 and pull rolls 13, 14, 15 to knife roll 16 where it is slit by a bar knife 17. The slit film passes over pull roll 18. Slit halves f pass over backup drive rolls 19, 20 and advance tangentially to winding rolls 21, 22. Such a tangential approach provides a hydrostatic air cushion which supports each film f prior to laydown. After substantial wraps on the winding rolls, the cushioned films reach solid, flexible, bowed idler rollers 23, 24. In the illustrated embodiment, there are wraps of about 270° before films f reach idler rollers 23, 24 which have diameters substantially less than the diameters of the winding and drive rolls. Each idler roller is located between a drive roll and a winding roll and has its rotational axis offset from the axes of those rolls. As shown, the winding rolls and idler rollers are swingably mounted on arms. Each winding roll is biased against and is surface driven by its idler roller which, in turn, is driven by its drive roll. The manner in which the idler rollers are first bowed and then twisted in the direction of advance for the film is described below with reference to FIGS. 4–7. The concentrated, bowed roll print of the relatively small rollers 23, 24 at laydown is surprisingly effective in blocking and discharging boundary air. At the same time, they spread films f on rolls 21, 22.

As shown in FIGS. 2 and 3, rear drive roll 20 is rotatably driven by a motor driven belt 26 and coupled with front drive roll 19 by spur gears 28. In addition, motor drive belts 30, 32 are coupled to winding rolls 21, 22. Both the winding and the drive rolls are rotatably driven in order to establish and maintain a minimum level of web feed tension at the idler roller.

Winding roll 21 is rotatably mounted between arm assemblies 34, 36 and rear roll 22 between arm assemblies 38, 40. The arm assemblies are fixed to shafts 42, 44 and torque is applied to those shafts, for swinging rolls 21, 22 toward and away from idler rollers 23, 24, by hydraulic, vaned, rotary actuators 46, 48. The actuators furnish enough rotary power to maintain the desired levels of pressure on the idler rollers. Rolls 21, 22 can, of course, be removed from the arm assemblies for the donning of empty cores and the doffing of cores with rolls of film thereon.

Idler roller 23 is rotatably mounted between arms 50, 52 and the latter are attached to adjusting rolls 54, 56. Arm 50 and roll 54 can be rotated by hand wheel 58 which is coupled to a bracket 60 through a shaft 62 and a chain 64. Between the reaches of chain 64, there is a connecting link 66 (FIG. 2). Arm 52 and roll 56 can also be adjusted, through a link and chain drive, by a hand wheel 68 (FIG. 3). Similarly, the pivot arms for idler roller 24 and the split rolls to which they are attached can be adjusted by hand wheels 70, 72.

The manner in which the idler rollers are flexed, bowed and then twisted in the direction of advance is shown in FIGS. 4A, 4B and 5. Hand wheels 70, 72 are turned to bring idler roller 24 into engagement with the enlarged portion of drive roll 20 and then turned further to bow the offset roller 24 to the position shown in FIGS. 4A and 5. When winding roll 22 is biased against roller 24, by rotary actuator 48, the roller is twisted upwardly to the position shown in FIG. 4B, producing a compound bow which, in effect, spring loads the roller against the winding roll.

Referring now to FIGS. 6 and 7, it will be seen that adjusting roll 54 is coupled to bracket 60 through a gearbox 74. Bracket 60 is attached to a ring 76 which is rotatable on box 74. Similarly, adjusting roll 56 is coupled to a bracket 77 through a gear box 78. Adjusting rolls 54, 56 are relatively rotatable on a support tube 79. Details of the manner in which one end of roller 23 is mounted for rotation in a housing 80 and the housing is attached to the thin, flat arm 50 are shown in FIG. 7. There is an identical housing 80 coupling the other end of roller 23 to arm 52. Between each housing and the legs of a yoke 82, there is a pin 84. Flexing and bowing of idler roller 23 is facilitated by rotational movements about pins 84 and slight twisting movements of flat arms 50, 52. Idler roller 24 is flexed and bowed by adjustments of rolls 86, 88 (FIG. 2) through gear boxes 90, 92, chains 94, 96 and hand wheels 70, 72.

In addition to the manual adjustments of idler rollers 23, 24, the flexible bearing arrangements shown in FIGS. 6 and 7 permit the operating bow in each idler roller to change in response to eccentricities between the driving and winding rolls and/or in response to variations in thickness of the film. The thicker lanes at gage bands lead to slight twisting of an idler roller into adjoining areas whereby boundary air would still accumulate and form bubbles. Thus, boundary air is blocked and discharged at laydown. In addition, the high contact pressure at the narrow footprint of the idler roller forces areas of film in the thicker lanes into closer proximity than the thinner areas by compressing the interface regions occupied by surface asperities. These cumulative effects of the self-adjusting idler rollers disclosed herein have led to the production of high quality rolls free from wrinkles. Furthermore, the quality of the wrinkle free, slit rolls does not degrade with time.

The apparatus is readied for slitting and rewinding by threading film F from mill roll 9 around rolls 10–16 and raising the blade of bar knife 17 to start a slit. Then, enough film is advanced beyond roll 16 to present, after a transverse cut by the operator, separate films f of sufficient length to reach pretaped cores on winding rolls 21, 22. With the latter pressing against idler rollers 23, 24, rolls of film f are wound. The concentrated roll prints of the relatively small idler rollers 23, 24 on winding rolls 21, 22 block and discharge boundary air. Furthermore the flexible resilience of those rollers and the flexibility of their pivotal mounts leaves them free to adjust automatically to variations in the surfaces of rolls as they are being wound.

In an operable embodiment, the idler roller was fabricated from a rod of a hardened steel alloy. The working surface was polished, had a diameter of 0.03 meter (m.), a working surface 0.96 m. in length and a bow span of 1.33 m. The enlarged portion of the driving roll was 0.81 m. in length and 0.159 m. in diameter. The ratio of operating diameters, driving roll to idler roller, was 5.3. The driving roll was fabricated from a hardened steel alloy and its working surface covered with a tough, abrasive resistant, elastomeric finish having a durometer hardness of 65–70. Rotary actuators 46, 48 were Rotac® fluid power rotary actuators, Model No. RN-63-RV, Ex-Cell-O Corp., Greenville, Ohio.

What is claimed as new and desired to be secured by Letters Patent is:

1. A film-winding apparatus comprising a winding roll, a drive roll and a flexible, bowed idler roller between and in contact with said rolls through their lengths, said apparatus further comprising a pair of pivoted arms and said idler roller being mounted between said arms.

2. The apparatus of claim 1 wherein said idler roller has its axis offset from the axes of said winding and drive rolls.

3. The aparatus of claim 2 wherein said idler roller has a diameter substantially less than the diameters of the winding and drive rolls.

4. The apparatus of claim 3, said apparatus further comprising means connected to each arm for biasing the idler roller against the drive roll to flex and thereby bow the roller.

5. The apparatus of claim 3 wherein said winding roll is mounted for swinging movement toward and away from the idler roller and said apparatus further comprising means for biasing the winding roll toward the idler roller and thereby twisting the bow in the idler roller.

6. In a film-winding apparatus including driven winding and backup rolls, the improvement comprising provision of a solid, flexible, idler roller mounted between pivoted arms and between and in contact with said rolls, said idler roller having a diameter substantially less than the diameters of said rolls, said arms each having means associated therewith for engaging the idler roller with the drive roll to flex and thereby bow the roller.

7. The apparatus of claim 6 wherein said winding roll is mounted for swinging movement toward and away from the idler roller and said apparatus further comprising means for biasing the winding roller toward the idler roller and thereby twisting the bow in the idler roller.

* * * * *